US006372118B1

(12) United States Patent
Hui

(10) Patent No.: US 6,372,118 B1
(45) Date of Patent: Apr. 16, 2002

(54) NI-FE-CO ELECTROPLATING BATH

(76) Inventor: Wen Hua Hui, #1 Highgate Dr., Apt. 208, Ewing, NJ (US) 08618

( * ) Notice: Subject to any disclaimer, the term of this patent is extended or adjusted under 35 U.S.C. 154(b) by 0 days.

(21) Appl. No.: 09/290,534

(22) Filed: Apr. 12, 1999

(51) Int. Cl.[7] ..... C25D 3/56
(52) U.S. Cl. ..... 205/259; 205/255
(58) Field of Search ..... 205/255, 259

(56) References Cited

U.S. PATENT DOCUMENTS

| | | | | | |
|---|---|---|---|---|---|
| 3,290,236 | A | | 12/1966 | Mayer | |
| 3,751,343 | A | | 8/1973 | Macula et al. | |
| 3,951,760 | A | | 4/1976 | Fueki et al. | |
| 3,966,564 | A | | 6/1976 | Hyner et al. | |
| 4,036,709 | A | * | 7/1977 | Harbulak | 205/259 |
| 4,108,740 | A | * | 8/1978 | Wearmouth | 101/348 |
| 4,183,789 | A | * | 1/1980 | Chessin et al. | 205/256 |
| 4,404,078 | A | | 9/1983 | Francis | |
| 4,421,611 | A | | 12/1983 | Cameron | |
| 4,450,051 | A | | 5/1984 | Tremmel | |
| 4,452,684 | A | | 6/1984 | Palnik | |
| 4,529,668 | A | | 7/1985 | Croopnick et al. | |
| 4,597,838 | A | | 7/1986 | Bammel | |
| 4,833,041 | A | | 5/1989 | McComas | |
| 5,213,907 | A | | 5/1993 | Caballero | |
| 5,314,608 | A | | 5/1994 | Caballero | |
| 5,324,406 | A | | 6/1994 | Anderson et al. | |
| 5,431,804 | A | | 7/1995 | Caballero | |
| 5,453,174 | A | | 9/1995 | Van Anglen et al. | |
| 5,587,006 | A | | 12/1996 | Shepherd et al. | |
| 5,614,003 | A | | 3/1997 | Mallory, Jr. | |

FOREIGN PATENT DOCUMENTS

| | | |
|---|---|---|
| EP | 0 243 627 | 11/1987 |
| EP | 0 361 451 | 4/1990 |
| GB | 1435267 | 10/1974 |
| GB | 1438552 | 6/1976 |
| GB | 1550876 | 12/1976 |
| GB | 1583216 | 9/1977 |

OTHER PUBLICATIONS

Tsuru, Toshiaki et al., "Electroplating of nickel–cobalt alloys from sulfate bath", retrieved from STN Database Accession No. 90:212151 ZCA XP002150045 Abstract & Kyushu Sangyo Daigaku Kogakubu Kenkyu Hokoku (1978), 15, 145–9. No month avail.

J.K. Dennis and T.E. Such:, "Nickel and Chromium Plating", 1972, Newnes–Butterworths, London XP002150044 2558, p. 95, line 1–line 6. No month avail.

Hui, Wenhua et al., "Microstructure and Mechanism of a New Type of Ni–Fe–W–P–S Wear Resistant Brush Plating Layer," Journal of Southeast University, Jun. 1994, vol. 10, No. 1.

Hui, Wen–Hua et al., "A Study on Friction and Wear Characteristics of Substitute Chromium Brush Plating Layers Under Lubrication." (1993). No month avail.

Hui, W.H. et al., "Corrosion Resistance of New Chromium Substituting Ni–Fe–W–P Brush Plating Layer," Surface Engineering (1994) vol. 10, No. 4. No month avail.

Hui, Wen–hua et al., "A Study of Wear Resistance of a New Brush–Plated Alloy Ni–Fe–W–S", Wear 192 (1996) 165–169. No month avail.

Hui, Wen–Hua et al., "A Study of Friction and Wear Characteristics of Electroless Ni–W–P Alloy Coatings." Proceedings of Third International Symposium on Tribology, Shanghai, (1997) p. 558–560. No month avail.

Hui, Wen Hua et al., "Special Grinding Technique—Electrochemical Flexibility Manufacturing Process." Fourth International Conference on Mfg. Technology, Hong Kong (1997). No month avail.

* cited by examiner

*Primary Examiner*—Kathryn Gorgos
*Assistant Examiner*—Wesley A. Nicolas
(74) *Attorney, Agent, or Firm*—Dilworth & Barrese

(57) ABSTRACT

A corrosion resistant and wear resistant nickel-iron-cobalt/hardener alloy or nickel-cobalt/hardener alloy having a brilliant luster is electrodeposited onto the surface of a substrate as an alternative to chromium plating. The plating solution contains nickel ions, cobalt ions, a completing agent, a reducing agent, a hardener and optionally, iron.

3 Claims, 7 Drawing Sheets

Ni-Fe-Co coating surface morphologies

Cr coating surface morphologies

Ni-Fe-Co coating composition

TEM of Ni-Fe-Co coating morphologies

Results of TEM analysis of intermetallic compound

X-ray diffraction result of Ni-Fe-Co coating

Ni-Co coating composition

NI-FE-CO ELECTROPLATING BATH

BACKGROUND OF THE INVENTION

1. Technical Field

The present invention relates to the deposition of metal alloys and more particularly to Ni—Fe—Co alloys.

2. Background of Related Art

Chromium plating offers unique deposit properties, including brightness, discoloration, stability at atmospheric conditions and long preservation of the luster. But the uniformity of the deposit is poor, the required current density is high, current efficiency is low, and the cost of energy is great. At the same time, chromium ions are poisonous. Chromium salts which escape in the form of a mist, or through the drainage of wastewater, present an environmental hazard, adversely affecting both the air and water resources, and pose a risk to human health.

It would be desirable to provide the beautiful color and luster, good corrosion resistance and excellent wear resistance of chromium coatings without the aforementioned shortcomings. Many substitute for chromium deposits have been investigated and developed, of which Sn—Co alloy is most promising. See, U.S. Pat. Nos. 3,966,564 and 3,951,760, the disclosures of which are incorporated herein by reference.

Compared with chromium plating deposits, Sn—Co alloy deposits have the following advantage:

(1) Sn—Co alloy deposits have the same luster and color as chromium deposits and can be used as decorative deposits.

(2) Corrosion resistance of Sn—Co alloy deposits is superior to that of chromium deposits and be used as advanced protection deposits.

(3) Sn—Co alloy deposits have good adhesion, excellent toughness, low internal stress, no porosity and no cracks.

(4) Throwing and covering power are very good.

(5) Current efficiency of Sn—Co alloy plating is one to four times higher than that of chromium plating.

(6) Because Sn—Co alloy plating is not poisonous, draining wastewater and mist can be easily handled.

But the hardness of Sn—Co alloy deposits is about Hv 500–600, and wear resistance is only one half that of chromium plating deposits.

In order to overcome the disadvantages of Sn—Co alloy deposits, some alloy deposits described have been developed as a new substitute for chromium deposits. For example, U.S. Pat. No. 4,529,668 discloses the electrodeposition of Co-B alloy. U.S. Pat. No. 5,614,003 discloses electroless deposition of Ni—Mo—P, Ni—Cu—P, Ni—Sn—P, Co—W—P and Ni—W—P alloys. These coatings have high hardness good wear resistance, and also have good corrosion resistance. But common problems in these process are that deposition rate is low, current efficiency is low and the cost of energy is great. For example, the electrodeposition rate of Co—W—B alloy (U.S. Pat. No. 4,529,608), is only 1.6–50 $\mu$m in six hours.

U.S. Pat. No. 4,833,041 discloses depositing on a substrate a quaternary alloy of nickel, cobalt, thallium and boron. The deposition is preferably electroless, but may be electrolytic, using a nickel anode and the substrate as the cathode, and using a fifty amps per square foot DC current. The electroless coatings comprise hard, amorphous, nodular deposits of metal alloy in somewhat softer metal or alloy matrix. The mass composition of the coasting has a ratio of nickel to cobalt of from about 45:1 to 4:1, the preferred compositions having a ratio of at least 5:1. The coating is heterogeneous in thickness cross-section, having higher cobalt concentrations at the interface of the coating and substrate. With heat treatment at 375 degree F., the nodules showed crystalline domains of metal borides dispersed in the metal alloy matrix. The heat-treated coating is reported to have knoop hardness values between 1230–1300. But thallium ions make the deposited surface passive and decrease the deposition rate too much. The techniques described in the '041 patent produce a coating with a rough surface.

U.S. Pat. Nos. 5,213,907, 5,314,608 and 5,431,804 disclose a dense, smooth, ductile, hard, highly reflective, corrosion resistance, temperature resistance and wear resistant cocrystalline alloy of nickel cobalt and boron. The alloy is epitaxially electrodeposited on an activated substrate using a pulsed square wave current. The epitaxial deposition occurs in an electrolytic bath containing nickel ions, cobalt ions, complexing agents, wetting agent, stress relief agent and an amino borage compound at a moderately low pH level and moderate temperature. An insoluble, solid catalyst, preferably palladium, causes the alloy to diffuse into the surface of the substrate and become bonded to it by a polar-covalent bond. But the patent doesn't disclose a complexing agent, wetting agent and stress relief agent. In order to get a good property of the coating, the current parameters, plating conditions and solution concentrations should remain constant. The chemical composition of the plating solution must be continuously analyzed and automatically. All of these conditions are very difficult to achieve in large scale production.

In order to overcome these disadvantages of prior known plating compositions and methods the present invention has been developed.

SUMMARY OF THE INVENTION

A novel alloy composition is provided herein. The alloy comprises from about 65 percent to about 75 percent by weight of nickel, from about 0 percent to about 20 percent by weight of iron, from about 15 percent to about 25 percent by weight of cobalt and from about 0.5 percent to about 1.5% of a hardening agent as defined herein.

The alloy is prepared by electrodeposition from a plating solution containing in solution based on the total metal content by weight of the solution from about 0 percent to about 25 percent iron, from about 10 percent to about 30 percent cobalt, from about 50 percent to about 80 percent nickel, from about 8 percent to about 20 percent of a reducing agent, from about 5 percent to about 15 percent of a completing agent and from about 3 percent to about 8 percent of a reducing agent.

The alloy can be deposited by (a) providing a substrate; (b) preparing the plating solution described above; (c) contacting the substrate with the plating d) providing an anode; and (e) applying an electric current to the anode and to the substrate for depositing a coating of the Ni—Fe—Co alloy onto a surface of said substrate.

DESCRIPTION OF PREFERRED EMBODIMENTS

Figure 1A:
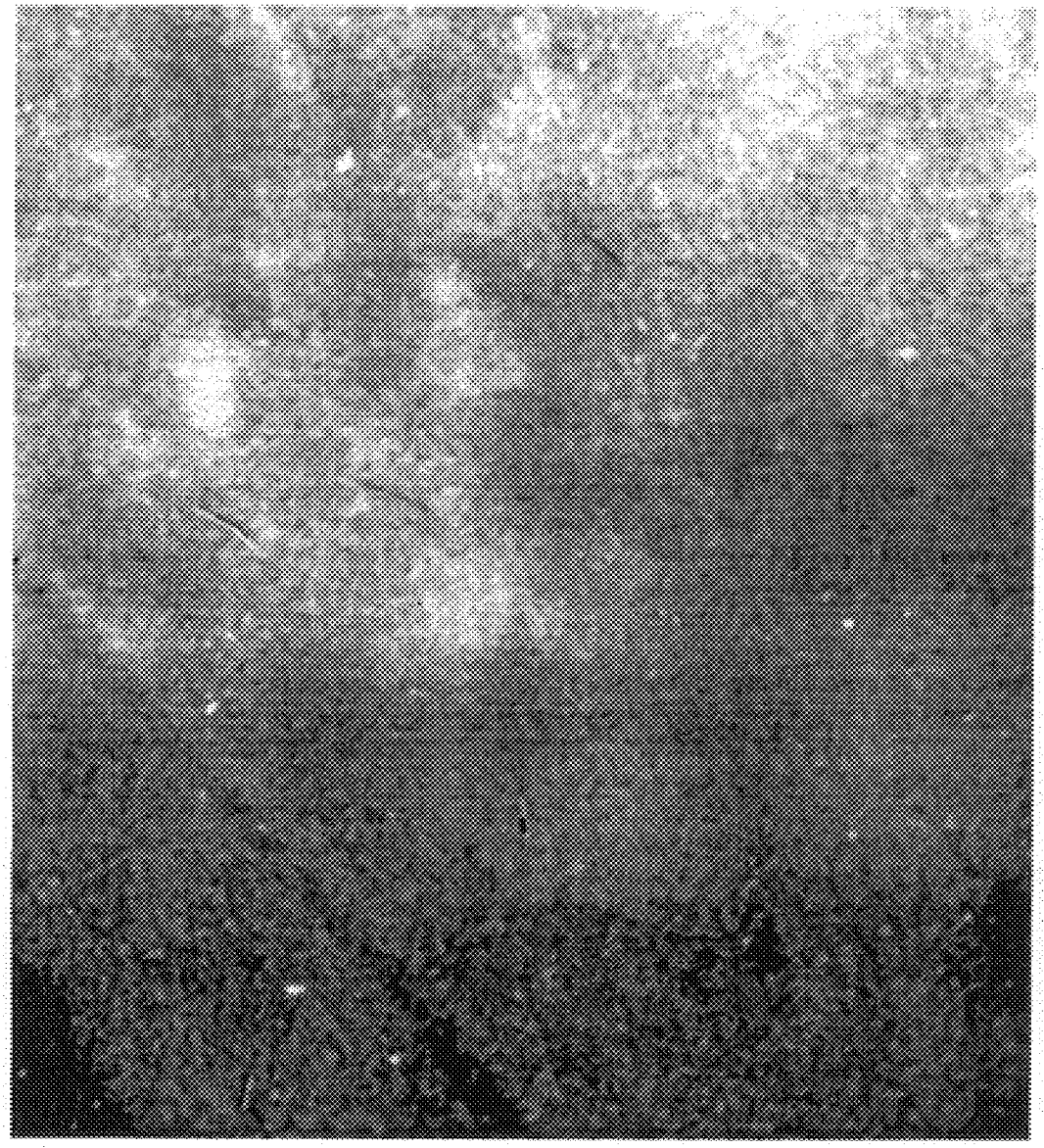
FIG. 1*a* is am illustration of Ni—Fe—Co coating surface morphologies.

All composition percentages herein are given by weight unless otherwise indicated.

The alloy deposited in accordance with the electrodeposition fluid and method describe herein is a Ni—Fe—Co alloy having a composition of about 65–75% nickel, about 0–20% iron, about 15–25% cobalt, and about 0.5–1.5% of a hardening agent. Structurally, the alloy consists of about 55–65% $Ni_3Fe$ crystals and about 35–45% $Ni_3Co$ crystals contained in a Ni-based solid solution. The grain size of nickel based solid solution is approximately 5.5–8.5 nm. The alloy exhibits high corrosion resistance due to the microcrystalline structure. The strengthening of intermetallic compound produces a high wear resistance. The alloy and the process and materials for its deposition are non-toxic. The alloy has a wear resistance about 2.0 times higher than of chromium deposits. Corrosion resistance, in NaCl system (ISO 3768) is about 2.6 times that of chromium deposits.

Using appropriate content of Ni and Fe, color that is similar to that of chromium deposits can be obtained. Fe and Co in a solid solution of Ni increase the alloy hardness and thermodynamic stability. With the increase of solution atoms, the stacking fault energy (SFE) decreases, making the wear cracks difficult to form and increasing wear resistance. A small amount of $Fe^{+3}$ (about 0.1–0.2 g/L) is desirable in a plating solution in that it helps to promote smooth, brighter and more level deposits.

Thus the plating solution can contain from about 0 percent to about 25 percent iron, from about 10 percent to about 30 percent cobalt, from about 50 percent to about 80 percent nickel, about 3 percent to about 8 percent of a hardening agent, about 5 percent to about 15 percent of a complexing agent, and about 8 percent to about 20 percent of a reducing agent. Preferably, the plating solution contains from about 10 percent to about 15 percent iron, about 15 percent to about 30 percent cobalt, from about 60 percent to about 80 percent nickel, from about 3 percent to about 8 percent hardening agent, about 5 percent to about 15 percent complexing agent, and about 8 percent to about 20 percent reducing agent.

Iron can be provided in the plating solution in any soluble form. Thus, for example, iron can be incorporated into the plating solution as ferrous sulfate ($FeSO_4$), ferrous chloride ($FeCl_2$), ferrous fluoborate, ferrous sulfamate and the like. Likewise, nickel can be provided in any soluble form such as, for example, nickel sulfate ($NiSO_4$), nickel chloride ($NiCl_2$), nickel acetate, ammonium nickel sulfate, nickel fluoborate and the like. Suitable cobalt soluble form such as, for example cobalt sulfate ($CoSO_4$) cobalt chloride ($CoCl_2$), cobalt acetate, ammonium cobalt sulfate and cobalt fluoborate.

By introducing a reducing agent into the iron alloy solution the $Fe^{+3}$ may be reduced to a minimum and thereby its harmful effect is limited. Suitable reducing agents include ascorbic acid, isoascorbic acid, maleic acid, muconic acid, muconic glucoheptonate, sodium hydroquinone benzyl ether, and aspartic acid. In exemplary embodiments the reducing agent may be present in the plating solution in an amount from about 2 to about 50 g/L, preferably for ascorbic acid, isoascorbic acid, maleic acid and muconic acid, an amount is about 2 to about 4 g/L. For glucoheptonate, sodium hydroquinone benzyl ether and aspartic acid an amount preferably is about 30 to about 50 g/L.

A complexing agent is also incorporated. When reducing agent and complexing agent are used in combination, bright leveled Ni—Fe—Co alloy deposits can be consistently obtained at alloy composition which exceed about 10% iron inclusion and reducing the amount of complexers which is required. Suitable complexing agents include citric acid, glutamic acid, gluconic acid and their salts. In exemplary embodiments the complexing agent may be present in the plating solution in an amount from about 10 to about 20 g/L.

In exemplary embodiments the plating solution also includes from about 2 to about 50 ml/L hardeners. Suitable hardening agents include 2-butyne-1,4-diol, phenylpropiolic acid, 2-butyne-1,4-disulfonic acid, 3-dimethylamino-1-propyne and bis(trimethylamine)-1,2-diphenyl-1,2-bis (dichloroboryl)ethylene. The hardener effectively makes grain size more fine and slows down the rate at which the nickel, iron and cobalt ions reach the substrate. This thereby provides a more uniform deposition of the coating on the substrate.

The pH of plating solution can be adjusted by acids, bases and buffers such as sulfuric acid or ammonium hydroxide, if necessary, to a range of from about pH 3.5 to about pH 4.5, preferably from about pH 3.8 to about pH 4.2.

Suitable substrates are those whose surfaces can be activated. Such substrates include iron, steel, stainless steel, nickel, cobalt, chromium, titanium, aluminum, tin, zinc, platinum, copper, brass, silver, and tungsten alloy and superalloys, and various other metals. Nonmetallic compounds, such as glass, ceramics and plastics may also be used as a substrate if they are sensitized. A nonmetallic substrate is commonly plated by electroless deposition of a film of tin and palladium on the surface of the tin. This is done, for example, by immersing the compound in a solution of stannous chloride and then immersing it in a solution of a palladium salt.

During the plating process, circulation of the plating solution bath in the tank is provided by filtration and agitation systems. The circulation and agitation helps to keep the anodes clean, benefits the alloy forming reaction by keeping ion concentrations relatively equal in all areas of the tank, and aids in producing a coating with a brilliant luster. A pump may continuously pump the plating bath through an activated carbon filter to provide circulation and remove contaminates.

During the plating procedure, the cobalt ions are preferably replenished in accordance with the amount of cobalt ions removed from the solution. The bath has a functionally unlimited life if the cobalt that is taken out is replaced. The remaining constituents are equilibrated by periodic analysis using conventional techniques known to those skilled in the art. For example, reducing agent and hardener additives in the bath should therefore be replenished periodically. The current parameters and working conditions should remain constant, and contaminants eliminated by known care and purification techniques.

Preferably a number of anodes, both nickel and iron, may be used. The ratio of the total anode surface area to the surface area of the part to be plated preferably ranges from about 1:1 to about 4:1. The ratio of the nickel anode surface area to the iron anode surface area preferably ranges from about 8:1 to about 10:1.

The Ni—Co and Ni—Fe—Co alloys described herein have remarkable physical and chemical properties, as deposited. They are highly brilliant and reflective, have a hardness in the range of 950 to 1200 as deposited and 1500 when heat treated, as measured using a Vickers hardness measuring device having 100 gm loads. The alloys are also highly resistant to heat, corrosion, and wear as deposited. The coating is not porous and does not have cracks. Corrosion resistance qualities have been found to surpass that of chromium, as well as that of electroless nickel-phosphorous, nickel-boron or nickel-cobalt-thallium-boron alloys. The brilliant appearance of nickel-iron-cobalt alloy competes with the appearance of chromium or rhodium. Its hardness is greater than that of hard chrome (Table 1), and it has excellent resistance to wear and corrosion (Tables 2 and 3). These alloys can be advantageously substituted for chrome, hard chrome and chrome alloy.

The friction and wear tests were conducted on a typical "ball-on-disc" testing machine. The surface morphology was observed under a JSM-6301F scanning electron microscope. The surface compositions were analyzed by a 9100 model energy dispersion X-ray analyzer. AD/max-RA model X-ray diffractometer was employed for analysis of phase constitution and a JEM 200-EX model transmission electron microscope was used for analysis of microstructure. Tafel curves were obtained by a Model 273 corrosion resistance tester available from EG&G Inc. of Wellesley, Mass.

As can be seen from Table 1 below, the Ni—Fe—Co alloy of the present invention has a higher Hv hardness rating (i.e., 1118) than the other compared coatings: hard chrome, heat treated electroless nickel with medium range phosphorous content ("EN Medium P", wherein P is about 6–9%) electroless nickel (as deposited) with medium range phosphorous content, electroless nickel as deposited with low range phosphorous content ("EN Low P", wherein P is less than about 4%), and WATTS nickel, i.e. nickel deposited from a standard WATTS solution of nickel sulfate, nickel chloride, and boric acid, with pH 3.0~5.0.

TABLE 1

HARDNESS OF DIFFERENT COATINGS

| Material | Hardness (Hv 100) |
|---|---|
| Ni—Fe—Co alloy | 1118 |
| Hard Chrome | 900 |
| EN Medium P (Heat treated) | 980 |
| EN Medium P (As deposited) | 550 |
| EN Low P (As deposited) | 700 |
| WATTS Ni | 200 |

As can be see from Table 2, below, the hardness of the Ni—Fe—Co alloy of the present invention can be increased by heat treatment at about 300° C. to about 500° C.

TABLE 2

(Hardness of Ni—Fe—Co coating at different temperatures)

| Temperature (° C.) | Hardness (Hv 100) |
|---|---|
| Ambient | 1118 |
| 100 | 1118 |
| 200 | 1118 |
| 300 | 1552 |
| 400 | 1422 |
| 500 | 1300 |
| 600 | 1190 |
| 700 | 1040 |

Table 3 below illustrates the wear rate and friction coefficient of the Ni—Fe—Co alloy of the present invention in comparison with hard chrome and various other alloys.

TABLE 3*

| Material | Wear Rate** | Friction Coefficient |
|---|---|---|
| Ni—Fe—Co | 110.56 | 0.12 |
| Hard Cr | 241.11 | 0.18 |
| EN Medium P (Heat Treatment) | 301.51 | 0.25 |
| EN Medium P (As deposited) | 506.46 | 0.26 |
| EN Low P (As deposited) | 409.07 | 0.31 |
| WATTS Ni | 1558.41 | 0.22 |

*Testing conditions: V = 1 m/s, P = 600 N, T = 30 min.
**$10^{-17}$ $m^3$/N.M

As can be seen from the above Table 3, the Ni—Fe—Co alloy of the present invention exhibited the lowest wear rate and the lowest coefficient of friction of the compared materials.

Table 4 below illustrates the corrosion resistance of the Ni—Fe—Co alloy of the present invention as compared with other coatings, the corrosion rate being determined by Tafel extrapolation.

TABLE 4

(Corrosion Rates of Various Coatings)

| Material | E (I = 0) | Cath. (Tafel) | Anod. (Tafel) | I Corr.* |
|---|---|---|---|---|
| Ni—Fe—Co | −261.69 | 116.93 | 57.91 | 0.0866 |
| Cr | −361.86 | 487.99 | 28.29 | 0.4200 |
| Cu—Ni—Cr | −406.50 | 735.52 | 44.32 | 0.2233 |
| Bright Ni | −305.15 | 376.42 | 1673.06 | 2.4533 |
| Zn—Ni | −834.01 | 516.34 | 41.43 | 2.4100 |
| Zn—Co | −949.17 | 1240.47 | 52.87 | 3.5566 |

*$\mu m/cm^2$
50 ± 1 g/L NaCl with pH in the region 6.0~7.0 (ISO3768)

As can be seen from Table 4, the Ni—Fe—Co alloy of the present invention has superior corrosion resistance.

The present Ni—Fe—Co alloy can be deposited on a substrate using any known technique, such as electroplating. Particularly useful deposition techniques are brush plating and tank plating. Various methods and apparatus for brush plating are known, such as those disclosed in U.S. Pat. Nos. 5,453,174; 5,324,406; 4,452,684; 4,404,078; 3,751,343; and 3,290,236, for example, and incorporated herein by reference.

Methods for preparing a plating solution in accordance with the present invention and for depositing a coating of the alloy of the present invention are illustrated in the following examples. The examples are included as exemplifications and are not intended to limit the scope of the invention.

EXAMPLE 1

Figure 1B:
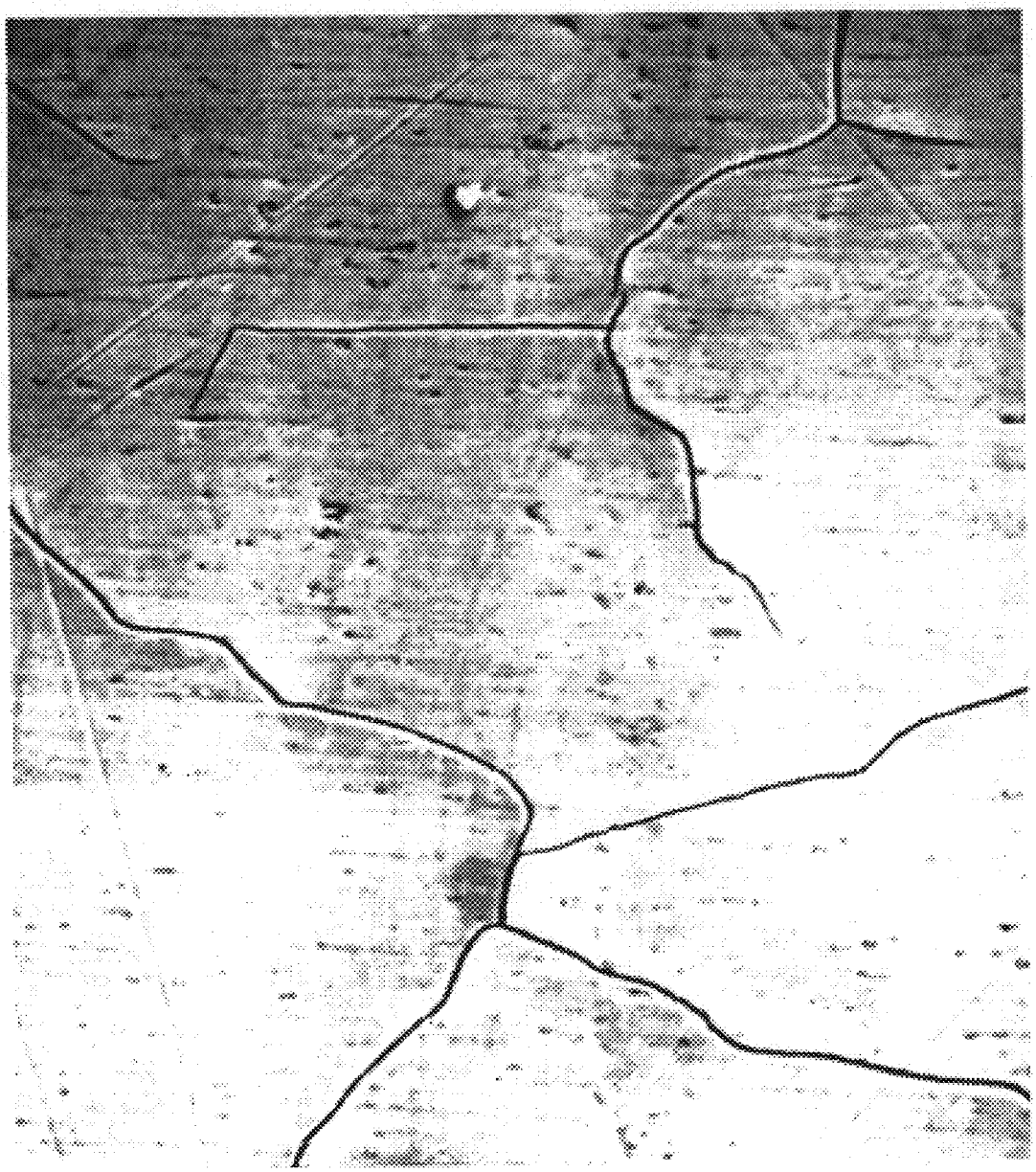
FIG. 1*b* illustrates chromium coated surface morphologies.
Figure 2:
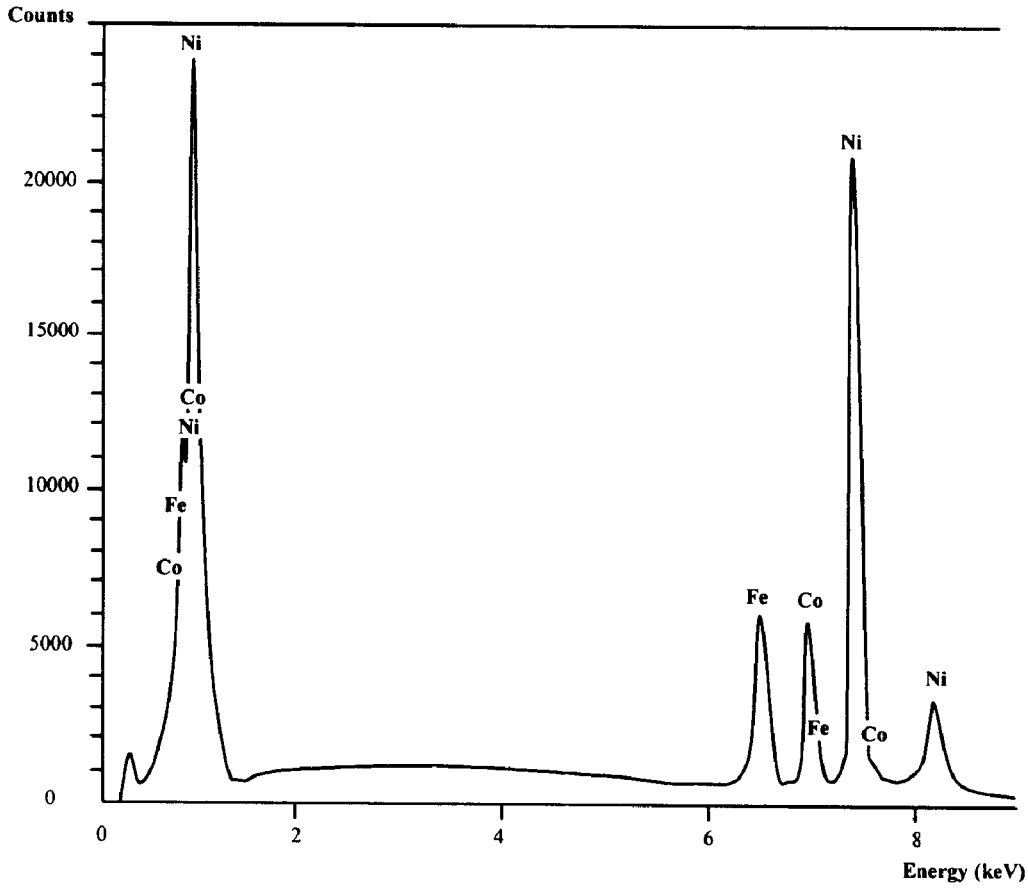
FIG. 2 is a pattern showing the results of energy dispersive X-ray analysis (EDAX) of a Ni—Fe—Co deposit.

A plating solution was prepared by heating twenty liters of distilled water to 70° C. 7.6 moles of nickel chloride ($NiCl_2.6H_2O$) were dissolved in the hot distilled water. 30.0 moles of nickel sulfate ($NiSO_4.6H_2O$) and 2.0 moles of cobalt sulfate ($CoSO_4.7H_2O$) were added to the nickel chloride solution. When the solution was well mixed, 15.0 moles of boric acid ($H_3BO_3$) were added and dissolved to form a first solution. A separate five liters of distilled water were heated to 50° C., and 3.1 moles of ferrous sulfate ($FeSO_4.7H_2O$) were dissolved in the hot distilled water. 6.0 moles of sodium hydroquinone benzyl ether ($C_{13}O_2H_{11}Na$) and 0.84 moles of sodium citrate ($Na_3C_6H_5O_7$) were added to the ferrous sulfate solution to form a second solution. When the second solution was well mixed, it was added to the 20 liters of first solution to form a third solution. After mixing of the first and second solutions was complete, the resulting third solution was filtered by using an activated carbon filter. The pH of the third solution was adjusted to 3.8 to 4.2 using 10% $H_2SO_4$ or 50% $NH_4OH$. 40 ml/L of bis (trimethylamine)-1,2-diphenyl-1,2-bis(dichloroboryl) ethylene hardener agent were added. Distilled water was added to make 30 liters volume. The solution was heated to 55° C. to form a plating solution. A sample piece of 1045 steel (20 cm×5 cm×0.5 cm) was pretreated by electrochemical cleaning and activated anodically. The sample was immersed in the plating solution described above and a Ni—Fe—Co coating was electrodeposited thereon. Multiple anodes, both nickel and iron, were used. The ratio of the total anode surface area to the surface area of the sample piece was 1:1, and nickel anode-iron anode surface area ratio was 10:1. The current density was 5 A/dm$^2$. After 40 minutes, the sample was removed from the bath. After rinsing and drying, the sample was measured with a micrometer. It was found to have a 0.00184 inch (46.6 $\mu$m) coating of Ni—Fe—Co alloy, which had a brilliant luster and a brightly reflective, mirror-like finish. It was non-porous and had no cracks (FIG. 1). Scanning electron microscopy examination using an EDAX-9100 Spectrometer revealed that the composition of the deposit at the surface as Table 5 and FIG. 2.

TABLE 5

COMPOSITION OF Ni—Fe—Co ALLOY COATING

| Elmt. | Spect. Type | Element % | Atomic % |
|---|---|---|---|
| FeK | ED | 11.97 | 12.32 |
| CoK | ED | 16.19 | 16.05 |
| NiK | ED | 72.02 | 71.63 |
| Total | | 100.00 | 100.00 |

Figure 3:
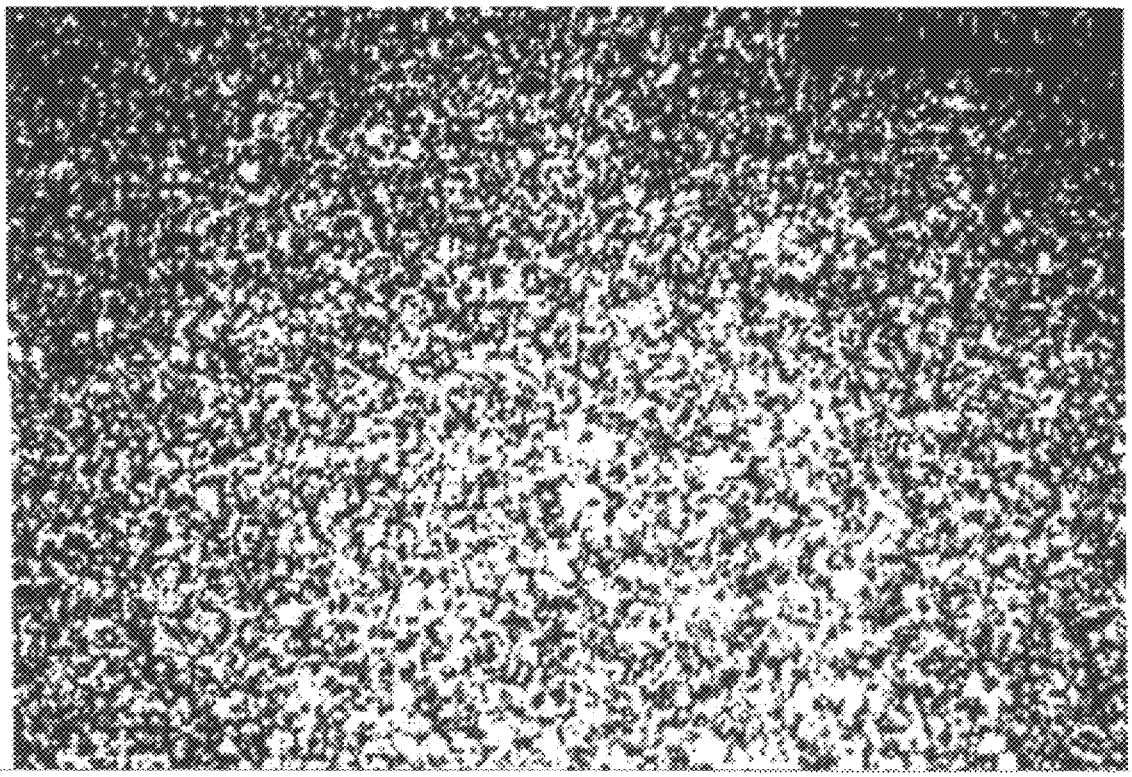
FIG. 3 is a transmission electron microscope (TEM) image of the Ni—Fe—Co coating.
Figure 4:
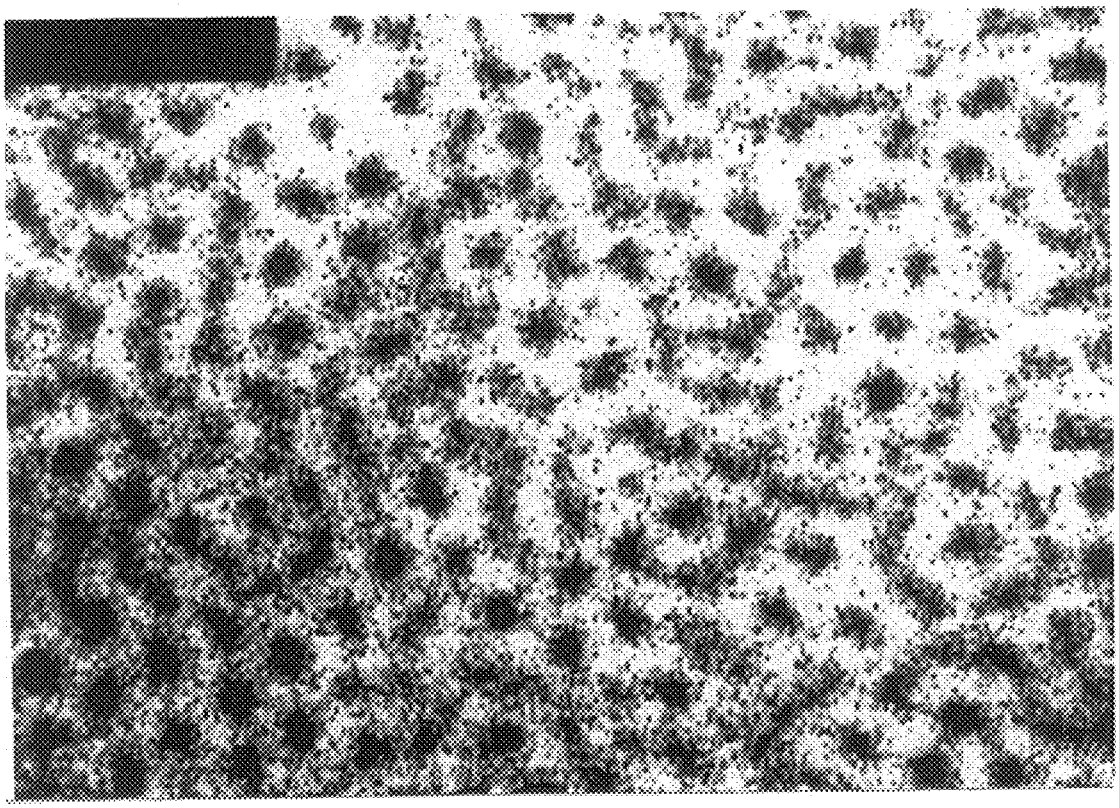
FIG. 4 shows the results of TEM analysis of an intermetallic compound.
Figure 5:
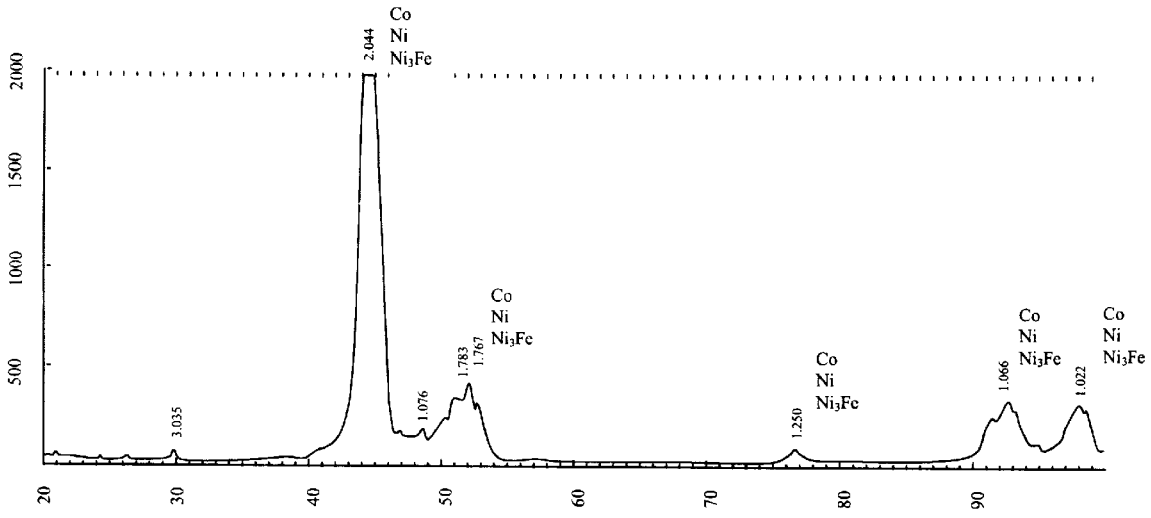
FIG. 5 is a pattern showing the results of X-ray diffraction analysis of a Ni—Fe—Co coating.

The grain size was 5.5 to 8.5 nm (FIGS. 3 and 5). FIG. 4 shows $Ni_3Fe$ and $Ni_3Co$ intermetallic compound dispersively distributed on matrix, which strengthens the material to a considerable extent due to the coherency of precipitated particles with the matrix.

The surface of the coated sample was found to have a hardness of 1219.8 using a Vickers hardness measuring device having a 100 gm loads. This is greater than the hardness of commercial grade nickel or nickel-boron alloy formed in an electroless system and is advantageously comparable with hard chrome. X-ray examination (FIG. 5) shows an X-ray diffraction pattern of Ni—Fe—Co alloy plating layer at room temperature. It can be seen that its structure is composed of a nickel based solid solution containing iron and cobalt and the intermetallic compound $Ni_3Fe$ and $Ni_3Co$.

EXAMPLE 2

The procedures of Example 1 were followed to deposit the Ni—Fe—Co alloy on twenty pieces 1045 steel with 20 mm in diameter and 3 mm thick. These samples were tested for wear resistance and corrosion resistance. The plating bath was prepared in the same manner as the bath of Example 1. The plating condition was same as Example 1, plating fo r 1 hour. The average coating thickness was 0.00283 inches (72 $\mu$m). The hardness of the coatings ranged from 1019.8 to 1183.2 (Hv100). The results of wear resistance and corrosion resistance wa s shown in Table 3 and Table 4, above.

EXAMPLE 3

Figure 6:
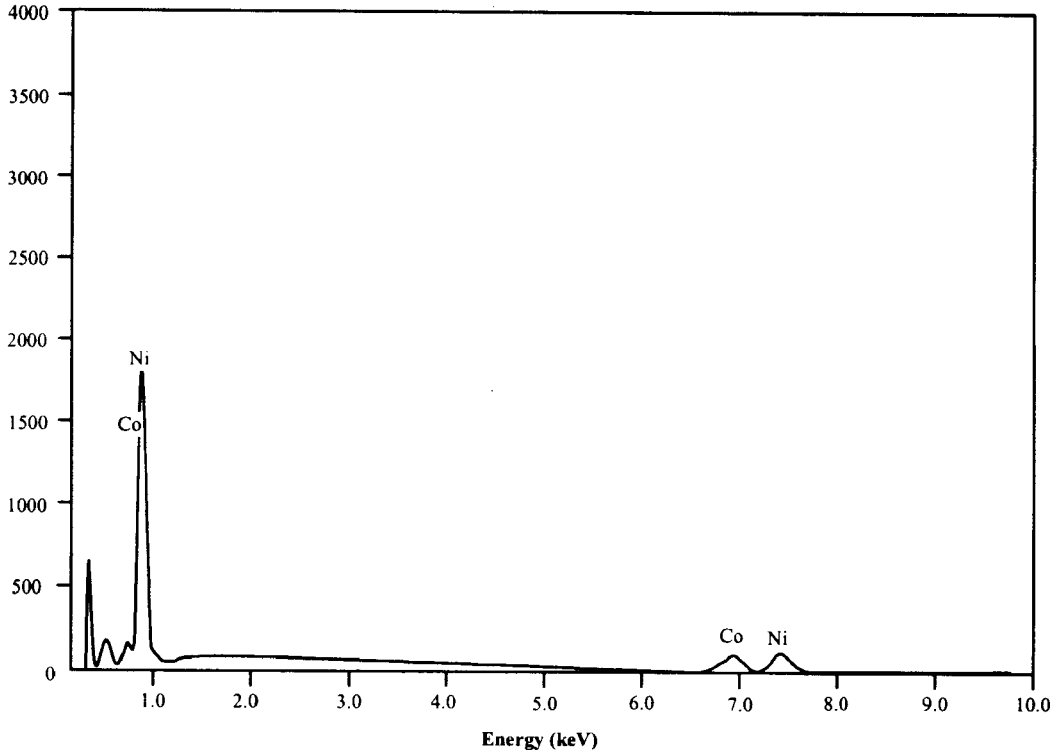
FIG. 6 is a pattern showing the results of energy dispersive X-ray analysis (EDAX) of Ni—Co deposits.

The procedure of Example 1 was followed except that no iron salt (ferrous sulfate) was included in the plating solution. Thu s, the alloy deposited was Ni—Co. The Ni—Co alloy thus produced exhibited better corrosion resistance than that of Ni—Fe—Co. But the hardness of Ni—Co alloy was only about 900 to 950 Hv100, as compared to a hardness of over 1000 for Ni—Fe—Co. The composition of Ni—Co allow is shown in FIG. 6.

While the above description contains many specifics, these specifics should not be construed as limitations on the invention but merely as exemplifications of preferred embodiments thereof. Those skilled in the art will envision many variations within the scope and spirit of the invention as defined by the claims appended hereto.

What is claimed is:

1. An electroplating solution comprising in solution based on the total metal content of the solution from about 0 percent to about 25 percent iron by weight, from about 10 percent to about 30 percent cobalt by weight, from about 50 percent to about 80 percent nickel by weight, from about 3 percent to about 8 percent hardening agent by weight, from about 5 percent to about 15 percent complexing agent by weight, and from about 8 percent to about 20 percent reducing agent by weight, wherein the hardening agent is selected from the group consisting of phenylpropiolic acid, 2-butyne-1,4-disulfonic acid, 3-dimethylamino-1-propyne and bis(trimethylamine)-1,2-diphenyl-1,2-bis (dichloroboryl)ethylene.

2. An electroplating solution comprising in solution based on the total metal content of the solution from about 0 percent to about 25 percent iron by weight, from about 10 percent to about 30 percent cobalt by weight, from about 50 percent to about 80 percent nickel by weight, from about 3 percent to about 8 percent hardening agent by weight, from about 5 percent to about 15 percent complexing agent by weight, and from about 8 percent to about 20 percent reducing agent by weight, wherein said reducing agent includes a compound selected from the group consisting of maleic acid, muconic glucoheptonate and sodium hydroquinone benzyl ether.

3. The solution of claim 2 wherein said reducing agent is sodium hydroquinone benzyl ether.

* * * * *